United States Patent [19]

Honma

[11] Patent Number: 4,693,464

[45] Date of Patent: Sep. 15, 1987

[54] APPARATUS FOR ARRANGING THE OBVERSE AND REVERSE SIDES OF THE BILLS OR THE LIKE

[75] Inventor: Nobuyuki Honma, Matsudo, Japan

[73] Assignee: Laurel Bank Machines Co., Ltd., Tokyo, Japan

[21] Appl. No.: 800,384

[22] Filed: Nov. 21, 1985

[30] Foreign Application Priority Data

Dec. 20, 1984 [JP] Japan ..... 59-193501[U]
Dec. 21, 1984 [JP] Japan ..... 59-194028[U]

[51] Int. Cl.[4] ..... B65H 5/26

[52] U.S. Cl. ..... 271/265; 271/291; 271/65; 271/186; 271/902; 209/545; 221/171

[58] Field of Search ..... 271/65, 184–186, 271/902, 265, 291; 209/534, 545; 221/171

[56] References Cited

U.S. PATENT DOCUMENTS 3,339,705 9/1967 Burkhardt et al. ..... 271/184
4,238,126 12/1980 Langdon ..... 271/65
4,456,236 6/1984 Buddendeck ..... 271/186
4,549,661 10/1985 Morishita et al. ..... 271/186

FOREIGN PATENT DOCUMENTS 0075392 5/1982 Japan .
0141350 9/1982 Japan .
0042552 3/1983 Japan .

*Primary Examiner*—Joseph J. Rolla
*Assistant Examiner*—Frederick R. Handren
*Attorney, Agent, or Firm*—Fleit, Jacobson, Cohn & Price

[57] ABSTRACT

An apparatus for arranging the obverse and reverse sides of the bills or the like includes a carrying-in passage and a carrying-out passage. A reversible conveying passage is provided between the carrying-in passage and the carrying-out passage for conveying the bills from the carrying-in passage in a direction identical or opposite to the carrying-in passage.

5 Claims, 6 Drawing Figures

APPARATUS FOR ARRANGING THE OBVERSE AND REVERSE SIDES OF THE BILLS OR THE LIKE

BACKGROUND OF THE INVENTION

This invention relates to an apparatus for arranging the obverse and reverse sides of bills or the like which is used as an internal mechanism of bill handling machines such as bill depositing and dispensing machines and bill arranging machines.

As a conventional apparatus for arranging the obverse and reverse sides of bills or the like, a mechanism is known in which bills or the like with their obverse and reverse sides in a mixed state are distributed into two conveying passages by means of a distributing device operated on the basis of the results of discrimination of the obverse and reverse sides in a discriminating section provided midway along a conveying passage. In one conveying passage the bills or the like are conveyed as they are, while in the other conveying passage the bills or the like are inverted by means of an inverting device provided at an intermediate portion thereof before they are allowed to join said one conveying passage, thereby arranging bills or the like so that their obverse and reverse sides conform with each other (Japanese Utility Model Publication No. 75392/1982 etc.)

In the aforementioned conventional apparatus for rearranging bills or the like, those on the obverse state are sorted from those in the reverse state and are caused to pass along different conveying passages. Since an inverting mechanism is provided in one conveying passage, however, it is difficult to accurately control the time required in the two types of process for arranging said bills after they pass the respective conveying passages and converge. Accordingly, it is difficult to set a fixed conveying interval for bills or the like and a conveying order, and it is impossible to secure continuous and smooth handling. Furthermore, the handling speed declines due to the presence of the inverting device, and the overall apparatus becomes complicated and large-sized owing to the arrangement of the two conveying passages, distributing mechanism, inverting mechanism, etc.

SUMMARY OF THE INVENTION

The present invention aims at overcoming the aforementioned conventional drawbacks and at making it possible to effect continuous and smooth handling by setting a fixed conveying interval and a conveying order for bills or the like, and further at realizing faster handling and a simplified and compact apparatus.

In one aspect, according to the present invention, there is provided an apparatus for arranging the obverse and reverse sides of bills or the like comprising: a rotary conveyor for forming a carrying-in passage for carrying in bills or the like with their obverse and reverse sides in the mixed state; a reversible conveyor forming a reversibly conveying passage for conveying the bills or the like in the direction identical or opposite to the carrying-in passage after carrying in the bills or the like conveyed from the carrying-in passage; a rotary conveyor for forming a carrying-out passage on an extension of the reversibly conveying passage on the carrying-in side; and a rotary conveyor which is communicated with the carrying end of the reversibly conveying passage in the same direction as the conveying direction thereof and is folded back substantially in a U-shape, thereby forming a return conveying passage for joining the carrying-out passage.

As another aspect, according to the present invention, there is provided an apparatus for arranging the obverse and reverse sides of bills or the like comprising: a carrying-in passage formed by rotary conveyors to carry in bills or the like with their obverse and reverse sides in the mixed state; a substantially U-shaped reversibly conveying passage formed in such a manner that one reversibly rotating conveyor is surrounded in a U-shape by another reversibly rotating conveyor and having a starting end leading from the outlet of the carrying-in passage in the conveying direction; a carrying-out passage formed by rotary conveyors such that the inlet thereof is located on an extension of the reversibly conveying passage on the side of the starting end; a first guide member at the time of retreat for guiding bills or the like from the starting end of the reversibly conveying passage into the inlet of the carrying-out passage at the time of retreat; and a second guide member at the time of advance for similarly guiding bills or the like from the terminating end of the reversibly conveying passage into the inlet of the carrying-out passage at the time of advance.

DESCRIPTION OF THE DRAWING

The present invention will now be described in detail with reference to the preferred embodiment illustrated in the accompanying drawings in with.

DESCRIPTION OF THE PREFERRED EMBODIMENTS

The present invention will now be described in detil by referring to the embodiments shown in the accompanying drawings.

Figure 1:
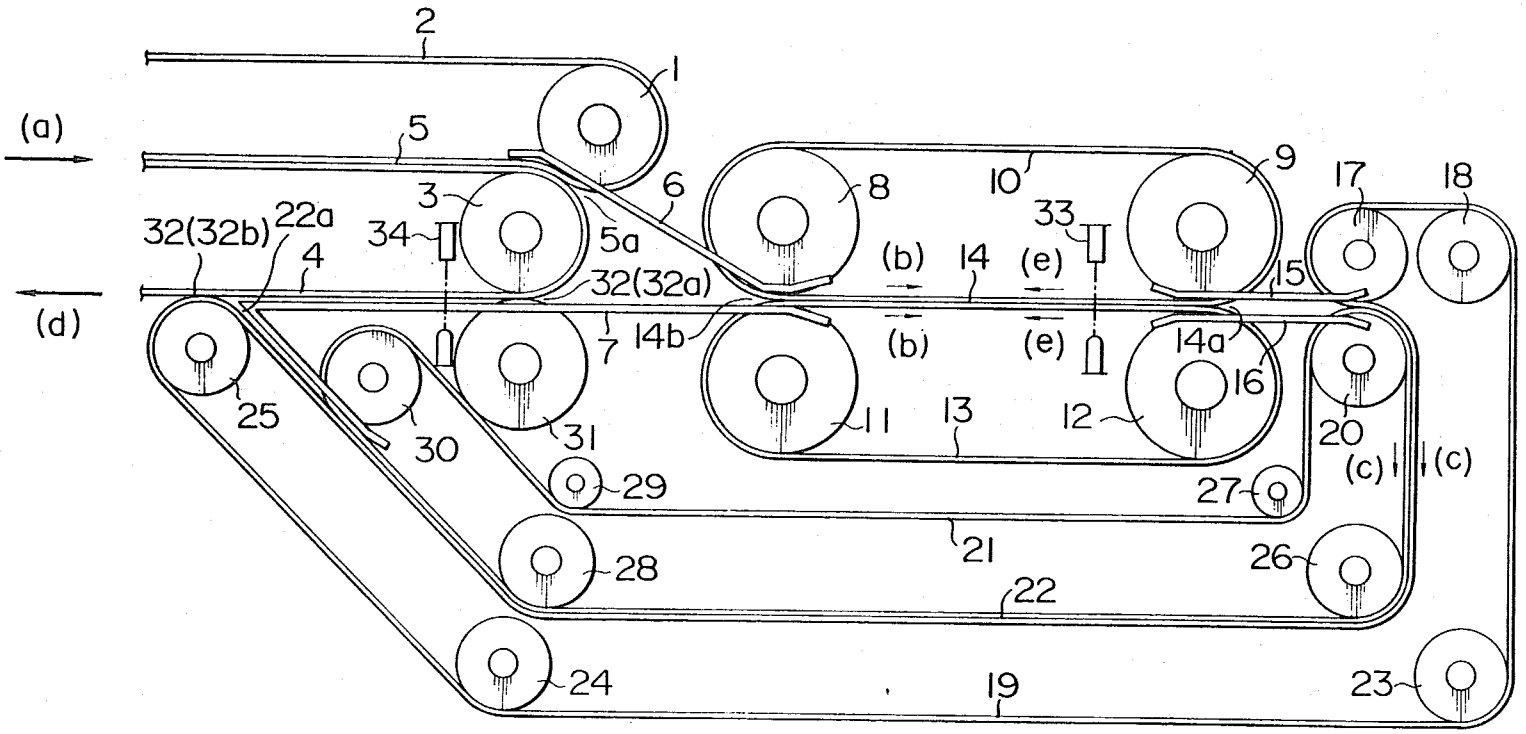
FIG. 1 is a schematic drawing illustrating an embodiment of the apparatus for rearranging bills on the like according to the present invention.

FIG. 1 shows a schematic drawing of an apparatus for arranging bills or the like with their obverse and reverse sides in conformity which is installed in a bill handling machine such as a bill depositing and dispensing machine for the purpose of sorting bills.

A conveyor belt 2 wound round a roller 1 and a conveyor belt 4 wound round a roller 3 are brought into contact with and opposed to each other, thereby forming a carrying-in passage 5 for carrying in bills with their obverse and reverse sides in the mixed state. The rollers 1 and 3 are opposed to each other diagonally, thereby forming a downwardly diagonal outlet end 5*a*. A guide plate 6 is disposed so as to incline downwardly from the upper position of this outlet end 5*a*, and a horizontal guide plate 7 is disposed in the lower position of the roller 3. A reversibly conveying belt 10 wound round reversible rollers 8, 9 and a reversibly conveying belt 13 wound round reversible rollers 11, 12 are brought into contact with each other, thereby forming a reversibly conveying passage 14 extending horizontally from the position of the front ends (the righthand side in FIG. 1) of the guide plates 6, 7 where the space between them is narrow. Guide plates 15, 16 are disposed at the position of a conveying end 14*a* in the front portion of this reversibly conveying passage 14.

At the same time, a conveyor belt 19 trained between rollers 17, 25 and guided by rollers 18, 23, 24, 20, 26 and 28 and a conveyor belt 21 trained between rollers 20, 30 and guided by rollers 26, 27, 28 and 29 at an intermediate point are brought into contact with and opposed to each other, thereby forming a return conveying passage 22 which is in the shape of a loop and which joins a carrying-out passage 32, to be described later, by being communicated with the conveying end 14*a* of the reversibly conveying passage 14 through the guide plates 15, 16 and by being folded back substantially in a U-shape. Furthermore, a carrying-out passage 32 having a conveying passage 32*b* between a carrying-out end 32*a* formed between the roller 3 and a roller provided therebelow on the one hand, and the roller 25 of the conveyor belt 19 forming the return conveyor passage 22 on the other, is formed on the lower side of the conveyor belt 4, so that the carrying-out passage 32 may be positioned on a horizontal extension of the reversely carrying passage 14 on the side of a carrying-in end 14*b*. The horizontal guide plate 7 positioned below the roller 3 extends to a position adjacent to the roller 25 at one end of the return conveying passage 22, and forms a converging port 22*a* as it is bent in such a manner as to run along conveyor belt 19.

In addition, a known photo-sensor 33 is disposed at a portion of the reversibly conveying passage 14 so as to detect the presence of a bill released from a clamp of the conveyor belts 2, 4 of the carrying-in passage 5 when it reaches a desired preset distance from where it starts to be carried into the reversibly conveying passage 14. Meanwhile, a photosensor 34 for detecting the presence of a bill released from a clamp of the reversibly conveying belts 10, 13 of the reversibly conveying passage 14 after those belts have been reversed, is provided at a portion of the carrying-out passage 32.

Next, the operation will be described.

Bills with their obverse and reverse sides in the mixed state, while keeping a desired preset conveying distance from each other, undergo discrimination with respect to their obverse and reverse sides at a discriminating section (not shown). Subsequently, the bills are conveyed by the carrying-in passage 5 in the clamped state as shown by an arrow (a) in FIG. 1, and then after being guided by the guide plates 6, 7 the bills are clamped by the reversibly conveying belts 10, 13 rotating in the direction of the arrow (b) and are carried into the reversibly conveying passage 14.

In cases where a bill carried into the reversibly conveying passage 14 is judged to be in the obverse state as a result of the discrimination of its obverse and reverse sides, the reversibly conveying belts 10, 13 rotate in the direction of the arrow (b), i.e., in the same direction as the carrying-in direction, and the bill is carried out from the reversibly conveying passage 14. After being guided by the guide plates 15, 16, the bill is clamped by the conveyor belts 19, 21 rotating in the direction of the arrow (c) and is conveyed along the return conveying passage 22 to join the carrying-out passage 32 at the converging port 22*a*. Then, the bill is caught by a conveying portion 32*b* which constitutes a part of the carrying-out passage 32 between the conveyor belts 4 and 19, and is then carried out in the direction of the arrow (d) in FIG. 1.

In cases where a bill carried into the reversibly conveying passage 14 is judged to be in the reverse state, the photo-sensor 33 detects the bill when it reaches a desired preset distance from where it starts to be carried into the reversibly conveying passage 14 after extricating itself from a clamp between the conveyor belts 2, 4 of the carrying-in passage 5. Subsequently, the photosensor 33 generates a signal which causes the reversible rollers 8, 9, 11 and 12 to be rotated reversely, which in turn causes the reversibly conveying belts 10, 13 to rotate in the opposite direction as shown by the arrow (e) so as to cause the bill once carried in to move backwardly. Thus, the bill is fed in the carrying-out end 32*a* of the carrying-out passage 32 along the guide plate 7. The bill caught by the carrying-out end 32*a* between the conveyor belt 4 and the roller 31 is held by the conveying portion 32*b* between the conveyor belts 4 and 19, and as in the case of the aforementioned bill, the bill is carried out in the direction of the arrow (d) in FIG. 1. Each of the bills is thus carried out after both those in the obverse state and those in the reverse state have been properly arranged.

As the aformentioned bill in the reverse state is carried out from the carrying-out passage 32, the photosensor 34 detects the bill after the bill is engaged by the conveyor belt 4 and the roller 31 and generates a signal which causes the reversible rollers 8, 9, 11 and 12 to resume their forward rotation, which in turn causes the reversibly conveying belts 10, 13 to resume their forward rotation in the direction of the arrow (b) in FIG. 1, thereby making ready for the next bill being carried in.

The embodiment is arranged as follows: A pair of conveyor belts 2, 4 are used as a rotary conveyor for forming the carrying-in passage 5. A pair of reversely conveying belts 10, 13 are used as a reversibly rotating conveyor for forming the reversely conveying passage 14. A pair of conveyor belts 19, 21 are used as a rotary conveyor for forming the return conveyor passage 22. The conveyor belt 4 which also serves as the carrying-in passage 5, the conveyor belt 19 which also serves as the return conveying passage 22, and the roller 31 are used as a rotary conveyor for forming the carrying-out passage 32. However, it is also possible to use rollers in place of belts as the respective rotary conveyors, as required. In addition, with respect to the carrying-out passage 32, it is also possible to use a separate rotary conveyor which cannot be used for other purposes.

Figure 2:
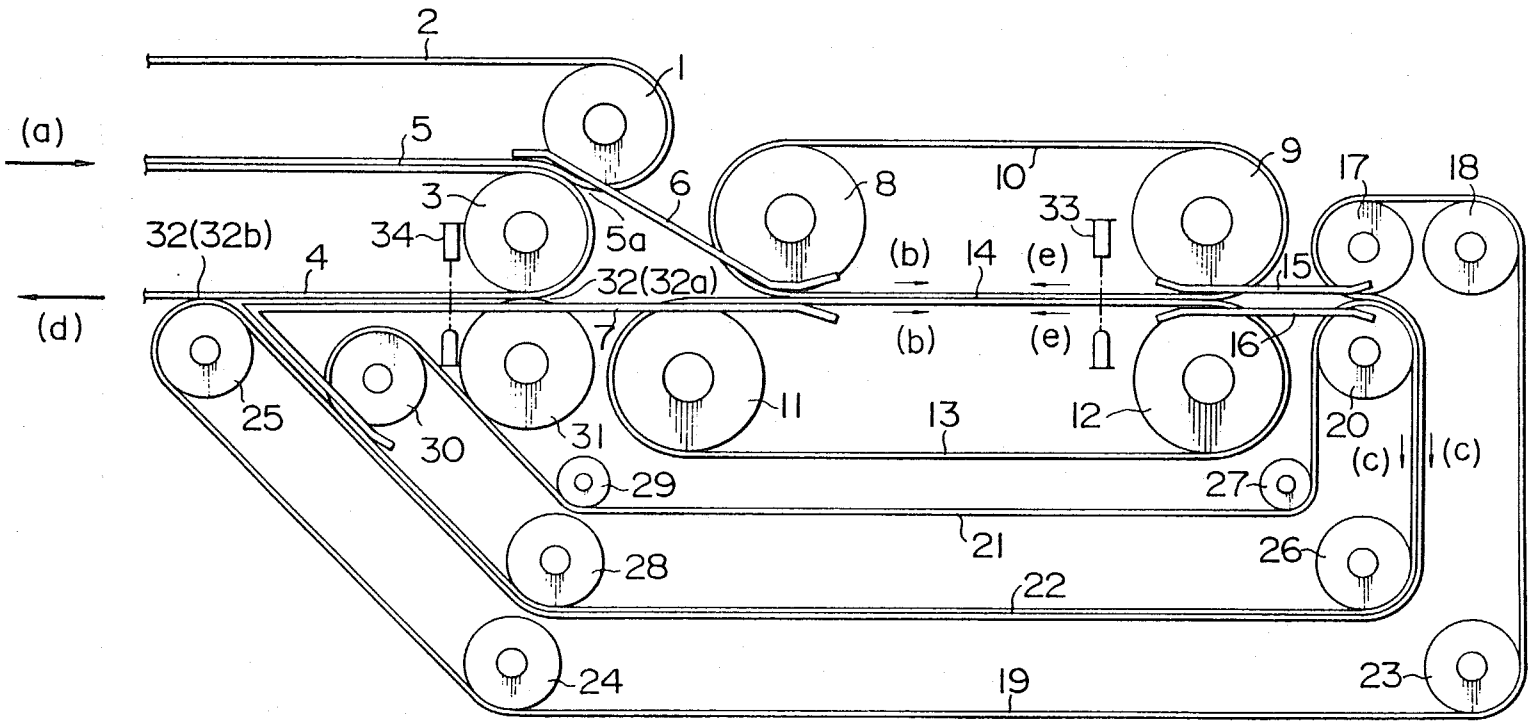
FIG. 2 is a schematic drawing illustrating another embodiment of the present invention.

FIG. 2 shows another embodiment, wherein the reversible roller 11 is provided at a position adjacent to the side of the carrying-out end 32*a*, and the reversibly conveying belt 13 on the lower side thereof is arranged such as to extend correspondingly. As a result, this arrangement properly effects the guiding of the front end of the bill from the carrying-in passage 5 or the guiding of the front end of the bill into the carrying-out end 32*a* at the time when the reversibly conveying belts 10, 13 are rotated reversely, thereby making smooth the delivery and reception of bills and making it possible to effect a faster handling. Other arrangements are be identical to those shown in FIG. 1.

Figure 3:
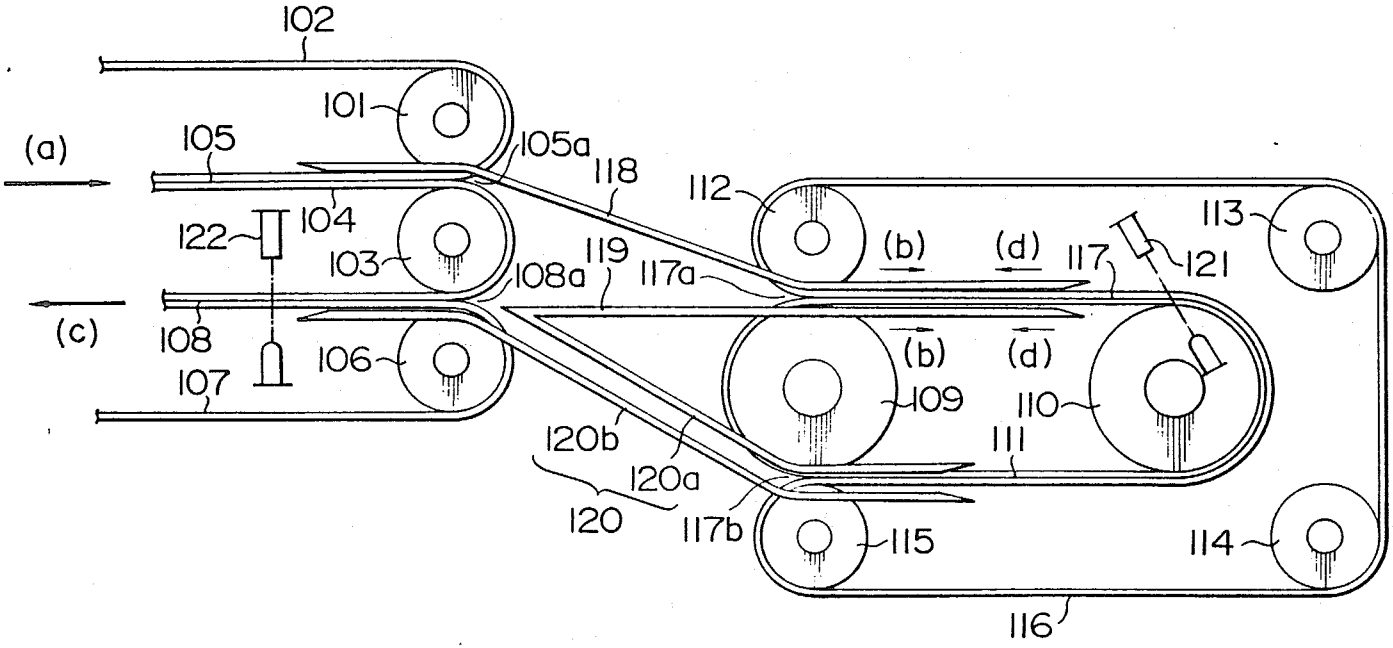
FIG. 3 is a schematic drawing illustrating a third embodiment of the present invention.

FIG. 3 shows a third embodiment of the present invention.

A conveyor belt 102 wound round a roller 101 and a conveyor belt 104 wound round a roller 103 are brought into contact with and opposed to each other, thereby forming a carrying-in passage 105 for carrying in bills with their obverse and reverse sides in the mixed state. Additionally, the lower side of the conveyor belt 104 and a conveyor belt 107 wound round a roller 106 are brought into contact with and opposed to each other, thereby forming a carrying-out passage 108.

Furthermore, a reversibly conveying belt 111 trained between reversible rollers 109, 110 is disposed at the front position slightly distant from the rollers 101, 103, and 106. At the same time, a reversibly conveying belt 116 wound round reversible rollers 112, 113, 114, and 115 located around this reversibly conveying belt 111 is provided to surround the reversibly conveying belt 111 in a U-shape, thereby forming a horizontally U-shaped reversibly conveying passage 117 by means of both the reversibly conveying belts 111, 116.

The starting end 117*a* of the reversibly conveying passage 117 is located in the front and diagonally lower position of the outlet 105*a* and is provided with a guide plate 118 for guiding the bills or the like from the outlet 105*a* to the starting end 117*a*. On the other hand, the inlet 108*a* of the carrying-out passage 108 is located on a horizontal extension of the reversibly conveying passage 117 on the side of the starting end 117*a* thereof. A horizontal guide member 119 is provided between the starting end 117*a* of the reversibly conveying passage 117 and the inlet 108*a* of the carrying-out passage 108 so as to guide a bill from the starting end 117*a* to the inlet 108*a*. Furthermore, the terminating end 117*b* of the reversibly conveying passage 117 is located downward of the starting end 117*a*. A guide member 120 at the time of advance constituted by two inclined parallel members 120*a*, 120*b* for guiding the bill from the terminating end 117*b* to the inlet 108*a* is provided between the terminating end 117*b* and the inlet 108*a* of the conveying passage 108. Incidentally, in this embodiment, the first guide member 119 and the second guide member 120*a* are formed integrally. In addition, the guide member 119 at the time of retreat also serves as a guide for the bill from the outlet 105*a* of the carrying-in passage 105 to the starting end 117*a* of the reversibly conveying passage 117.

Furthermore, a known photo-sensor 121 for detecting a bill released from a clamp of the conveyor belts 102, 104 of the carrying-in passage 105 when it arrives at a desired preset distance from where it starts to be carried into the reversibly conveying passage 117 is disposed at a horizontal portion on the upper side of the reversibly conveying passage 117. A photo-sensor 122 for detecting a bill released from a clamp of the reversibly conveying belts 111 and 116 of the reversibly conveying passage 117, after those belts have been reversed, is disposed at a portion of the carrying-out passage 108.

Next, description of the operation will be made.

Bills with their obverse and reverse sides in the mixed state, while keeping a desired preset conveying distance from each other, undergo discrimination with respect to their obverse and reverse sides in a discriminating section (not shown). Subsequently, the bills are conveyed by the carrying-in passage 105 on the clamped state as shown by the arrow (a) in FIG. 1. After leaving the outlet 105*a* thereof, the bill is guided by the guide plate 118 and the guide member 119 at the time of retreat, is then clamped by the reversibly conveying belts 111, 116 rotating in the direction of the arrow (b), and is carried from the starting end 117*a* thereof onto the reversibly conveying passage 117.

In cases where the bill carried onto the reversibly conveying passage 117 is judged to be in the obverse state as a result of discrimination of its obverse and reverse sides, the reversibly conveying belts 111, 116 rotate as they are in the direction of the arrow (b), i.e., in the same direction as the carrying-in direction, the bill is fed out from the terminating end 117*b* of the reversibly conveying passage 117. The bill is carried onto the carrying-out passage 108 from the inlet 108*a* thereof while being guided by the guide member 120 at the time of advance, and is carried out from the carrying-out passage 108 in the direction of the arrow (c) in FIG. 3.

Meanwhile, in cases where the bill carried onto the reversibly conveying passage 117 is judged to be in the reverse state, the photo-sensor 121 detects the bill at a desired preset distance from which it starts to be carried into the reversibly conveying passage 117 after extricating itself from a clamp between the conveyor belts 102, 104 of the carrying-in passage 105. Subsequently, the reversible rollers 112, 113, 114, and 115 as well as the reversibly conveying belts 111, 116 are rotated reversely in the direction of the arrow (d) so as to cause the bill once carried in to move backwardly. Then, the bill is fed into the carrying-out passage 108 from the inlet 108*a* thereof along the guide member 119, as the case of the bill in the obverse state, and is delivered in the direction of the arrow (c). Thus, each of the bills is carried out from the same carrying-out passage 108 in a state in which both the bills in the obverse state and those in the reverse state are properly arranged.

As the aforementioned bill in the reverse state is carried out from the carrying-out passage 108, the photo-sensor 122 detects the bill, while being held by the conveyor belts 104, 107 so as to be conveyed in the clamped state, and generates a signal which causes the reversibly conveying belts 111, 116 to resume their forward rotation in the direction of the arrow (b), thereby making ready for the next bill being carried in.

The embodiment is arranged as follows: A pair of conveyor belts 102, 104 are used as a rotary conveyor for forming the carrying-in passage 105. A pair of reversely conveying belts 111, 116 are used as a reversibly rotating conveyor for forming the reversely conveying passage 117. The conveyor belt 104 which also serves as the carrying-in passage 105 and another conveyor belt 107 are used as a rotary conveyor for forming the carrying-out passage 108. However, it is also possible to use rollers in place of belts as the respective rotary conveyor, as required. In addition, with respect to the carrying-out passage 108, it is also possible to use a separate rotary conveyor which connot be used for other purposes.

Figure 4:
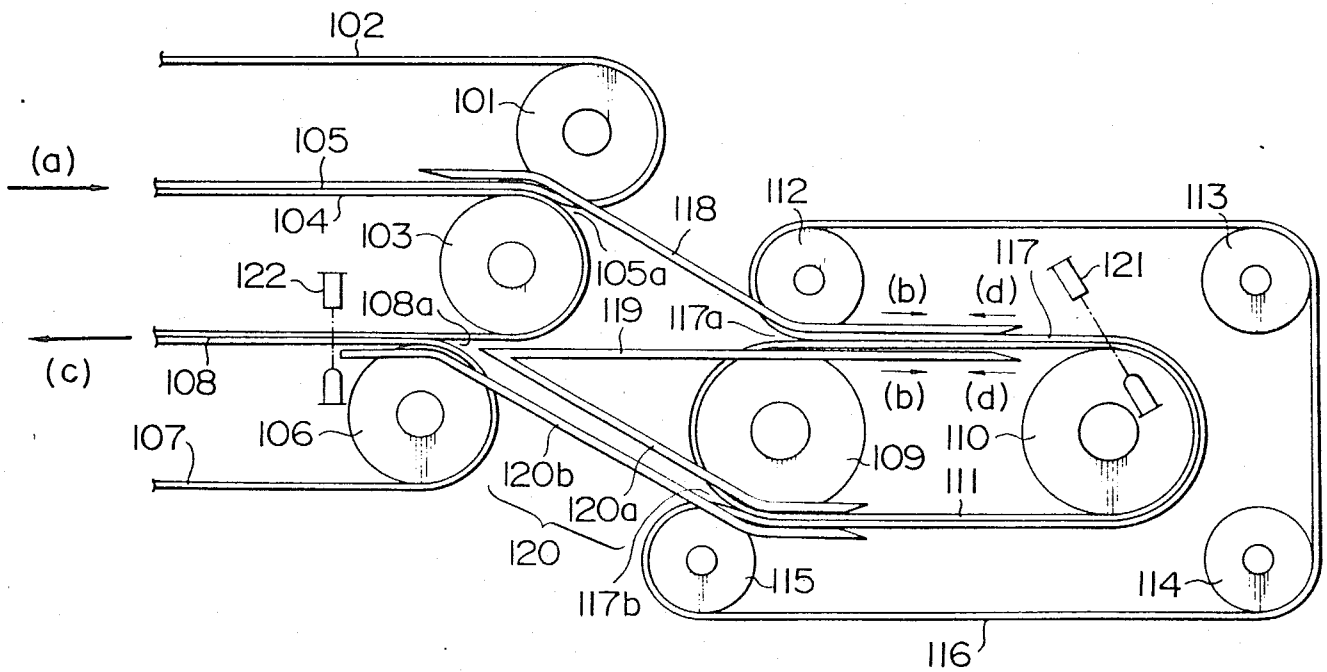
FIG. 4 is a schematic drawing illustrating a fourth embodiment of the present invention.

FIG. 4 shows a fourth embodiment which is arranged such that the position of the roller 101 on the upper side of the carrying-in passage 104 is offset rightwardly (i.e., to the side of the rearwardly conveying passage 117) as viewed in the figure along the periphery of the lower roller 103, the position of the intermediate reversible roller 109 on the side of the starting end 117*a* of the reversibly conveying passage 117 is offset horizontally leftwardly as viewed in the figure, the position of the reversible roller 115 below the terminating end 117*b* of the reversibly conveying passage 117 of offseet leftwardly as viewed in the figure along the periphery of the reversible roller 109 on the upper side thereof, and the roller 106 on the lower side of the carrying-out passage 108 is offset horizontally leftwardly in the figure.

According to the arrangement of the aforementioned embodiment, it is possible to direct the tangential direction of the outlet 105*a* of the carrying-in passage 105 toward the starting end 117*a* of the reversibly conveying passage 117. At the same time, it is possible to enlarge the taking-in surface of the starting end 117*a* of the reversibly conveying passage 117. Therefore, it becomes possible to make smoother the reception and delivery of bills between the carrying-in passage 105 and the reversibly conveying passage 117. Also, since the reception and delivery of bills from the terminating end 117*b* of the reversibly conveying passage 117 can similarly be effected smoothly, it becomes possible to readily cope with a speedly handling of bills.

Figure 5:
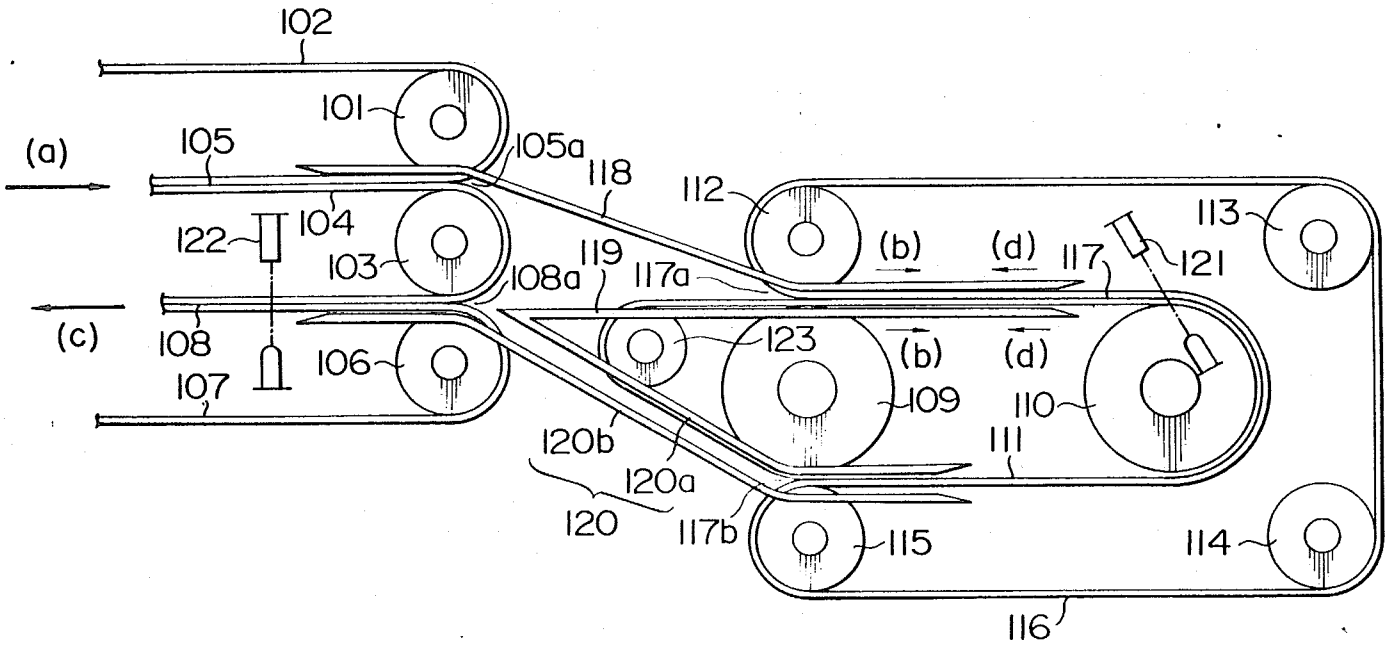
FIG. 5 is a schematic drawing illustrating a fifth embodiment of the present invention.

FIG. 5 shows a fifth embodiment. A small diameter reversible roller 123 is disposed leftwardly as viewed in the figure of the intermediate reversible roller 109, i.e., in the direction of the inlet 108*a* of the carrying-out passage 108.

The reversibly conveying belt 111 is wound round the reversible rollers 109, 110, and 123.

According to the aforementioned embodiment, since the portion of the reversibly conveying belt 111 in the vicinity of the added reversible roller 123 effectively guides the tip of a bill at the time when the bill is carried onto the reversibly conveying passage 117 from the carrying-in passage 105, and prompts the feeding of the bill from the reversibly conveying passage 117 onto the carrying-out passage 108 at the time of inversion, the reception and delivery of bills on such occasions can be effected smoothly.

Figure 6:
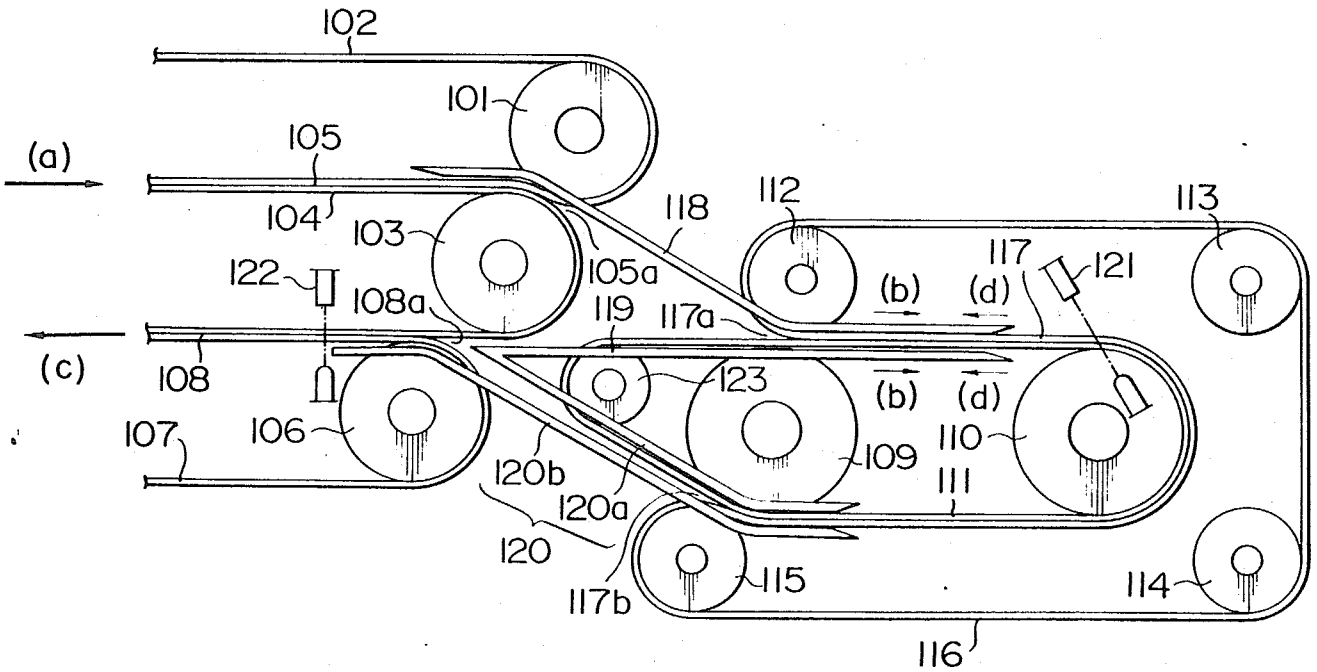
FIG. 6 is a schematic drawing illustrating a sixth embodiment of the present invention.

FIG. 6 shows a sixth embodiment. This embodiment incorporates the embodiment shown in FIG. 4 and the embodiment shown in FIG. 5. In other words, the rollers 101, 106 are offset in relation to the intermediate roller 103, the reversible roller 109 is offset in relation to the reversible roller 112, and the reversible roller 115 in relation to the reversible roller 109, and the small-diameter roller 123 is disposed leftwardly of the reversible roller 109 as viewed in the figure.

According to the aforementioned embodiment, since the advantages of both the embodiment shown in FIG. 4 and the embodiment shown in FIG. 5 can be obtained, it becomes possible to effect the reception and delivery of bills even more smoothly.

As described above, according to the present invention, the arrangement is such that a substantially U-shaped reversibly conveying passage capable of taking forwardly and reversely conveying directions, and, depending on whether bills or the like have their obverse or reverse sides facing upwards, a bill or the like carried onto the reversibly conveying passage from the starting end thereof through the carrying-in passage is conveyed as it is in the conveying direction and is, from the terminating end thereof, carried onto the carrying-out passage from the inlet thereof through the guide member at the time of advance, or, alternatively, is carried onto the carrying-out passage from the inlet of the carrying-out passage on an extension of the reversibly conveying passage on the side of the starting end thereof after returning the bill or the like once carried onto the reversibly conveying passage from the starting end thereof. Accordingly, all the movements of the bills or the like are carried out positively, and, therefore, unlike a conventional apparatus in which bills or the like are distributed in two directions and an inverting mechanism is provided in one route, the apparatus of the invention makes it easy to accurately control the time required in the respective processes of dealing with bills or the like in both the obverse and reverse states. Hence, it becomes possible to feed out bills or the like with their obverse and reverse sides in the mixed state at fixed conveying interval and carrying order after arranging their obverse and reverse sides. At the same time, the handling thereof can also be effected smoothly at a fast speed. Furthermore, because of the fact that an inverting mechanism is not required and for other reasons, the arrangement can be simplified remarkably, thus allowing the overall apparatus to become compact.

What is claimed is:

1. An apparatus for arranging the obverse and reverse sides of bills or the like comprising:

a carrying-in passage for carrying in bills or the like with their obverse and reverse sides in the mixed state, a reversibly conveying passage for receiving said bills or the like therein from said carrying-in passage and conveying said bills or the like forward or backward, a carrying-out passage for carrying out said bills or the like, arranged in alignment with said reversibly conveying passage so that said reversibly conveying passage and said carrying-out passage form a linear passage, a return conveying passage for receiving said bills or the like transferred forward from said reversibly conveying passage and transferring said bills or the like to said carrying-out passage, first sensing means positioned in the reversibly conveying passage for sensing the presence of one of the bills within the reversibly conveying passage and generating a first signal, which is used to control the changing of the reversibly conveying passage from a forward movement state to a backward movement state, and second sensing means positioned in the carrying-out passage for sensing the presence of one of the bills within the carrying-out passage and generating a second signal, which is used to control the changing of the reversibly conveying passage from the backward movement state to the forward movement state.

2. Apparatus according to claim 1 wherein said carrying-in passage and said carrying-out passage are arranged one above the other and parallel to each other.

3. Apparatus according to claim 1 wherein each of said carrying-in and carrying-out passages is formed between a pair of belts driven by rollers.

4. Apparatus according to claim 1 wherein said reversibly conveying passage and said return conveying passage are formed by a pair of belts.

5. Apparatus according to claim 1 wherein said return conveying passage is formed in a loop to cause inversion of a bill being transferred thereby from the reversibly conveying passage to the carrying-out passage.

* * * * *